US010738442B2

(12) United States Patent
Olsson et al.

(10) Patent No.: US 10,738,442 B2
(45) Date of Patent: Aug. 11, 2020

(54) AUTOMATIC TUNING OF VALVE FOR REMOTE CONTROLLED DEMOLITION ROBOT

(71) Applicant: HUSQVARNA AB, Huskvarna (SE)

(72) Inventors: Tommy Olsson, Mölndal (SE); Fredrik Theander, Stenkullen (SE)

(73) Assignee: HUSQVARNA AB, Huskvarna (SE)

( * ) Notice: Subject to any disclaimer, the term of this patent is extended or adjusted under 35 U.S.C. 154(b) by 171 days.

(21) Appl. No.: 15/769,490

(22) PCT Filed: Oct. 19, 2016

(86) PCT No.: PCT/SE2016/051015

§ 371 (c)(1),
(2) Date: Apr. 19, 2018

(87) PCT Pub. No.: WO2017/069689

PCT Pub. Date: Apr. 27, 2017

(65) Prior Publication Data

US 2018/0282972 A1 Oct. 4, 2018

(30) Foreign Application Priority Data

Oct. 19, 2015 (SE) ..... 1551347

(51) Int. Cl.
*E02F 9/20* (2006.01)
*E02F 3/96* (2006.01)
(Continued)

(52) U.S. Cl.
CPC ..... *E02F 9/205* (2013.01); *E02F 3/966* (2013.01); *E02F 9/2267* (2013.01); *E02F 9/265* (2013.01);
(Continued)

(58) Field of Classification Search
CPC ..... E02F 9/205; E02F 3/966; E02F 9/2267; E02F 9/265; E02F 9/268; F15B 13/0416;
(Continued)

(56) References Cited

U.S. PATENT DOCUMENTS 2,008,053 A 7/1935 Whiteside
2,160,217 A 5/1939 Kingsbury
(Continued)

FOREIGN PATENT DOCUMENTS

CN 1457398 A 11/2003
CN 101245871 A 8/2008
(Continued)

OTHER PUBLICATIONS

International Search Report and Written Opinion for International Application No. PCT/SE2016/051021 dated Jan. 12, 2017.
(Continued)

*Primary Examiner* — Calvin Cheung
(74) *Attorney, Agent, or Firm* — Burr & Forman, LLP

(57) ABSTRACT

A remote controlled demolition robot (10) comprising a controller (17) and at least one control switch (24, 25, 26) for providing a control signal that is received by the controller (17), wherein the controller (17) is configured to control the operation of a corresponding robot part (10*a*, 11, 14, 15). The controller (17) is further configured to: receive a pressure sensor reading from a pressure sensor (13*b*) for a proportional hydraulic valve (13*a*), said pressure sensor reading indicating a standby pressure; provide the control signal to the valve (13*a*); and increase a signal level of the control signal provided to the valve (13*a*) until a change in the pressure is detected; determine a starting offset for the valve (13*a*), said starting offset corresponding to the current signal level of the control signal.

15 Claims, 5 Drawing Sheets

(51) Int. Cl.

| | |
|---|---|
| ***E02F 9/22*** | (2006.01) |
| ***E02F 9/26*** | (2006.01) |
| ***F15B 19/00*** | (2006.01) |
| ***F15B 13/04*** | (2006.01) |

(52) U.S. Cl.
CPC ..... *E02F 9/268* (2013.01); *F15B 13/0416* (2013.01); *F15B 19/002* (2013.01); *F15B 2211/6306* (2013.01); *F15B 2211/851* (2013.01); *F15B 2211/853* (2013.01)

(58) Field of Classification Search
CPC ..... F15B 19/002; F15B 2211/6306; F15B 2211/851; F15B 2211/853
See application file for complete search history.

(56) References Cited

U.S. PATENT DOCUMENTS

| | | | | |
|---|---|---|---|---|
| 2,214,389 | A | 9/1940 | Wahlmark | |
| 2,427,970 | A | 9/1947 | Mathys | |
| 3,228,659 | A | 1/1966 | Sturm | |
| 3,963,039 | A | 6/1976 | Coeurderoy | |
| 4,121,610 | A | 10/1978 | Harms et al. | |
| 5,222,417 | A | 6/1993 | Sato | |
| 5,235,809 | A | 8/1993 | Farrell | |
| 5,355,676 | A * | 10/1994 | Inokuchi | F15B 1/02 60/413 |
| 6,058,632 | A | 5/2000 | Hawkins | |
| 6,138,810 | A | 10/2000 | Fujii et al. | |
| 6,305,162 | B1 | 10/2001 | Cobo et al. | |
| 6,397,655 | B1 | 6/2002 | Stephenson | |
| 6,523,629 | B1 * | 2/2003 | Buttz | B60D 1/00 180/14.2 |
| 6,571,190 | B2 | 5/2003 | Hou et al. | |
| 6,792,902 | B2 | 9/2004 | Simpson | |
| 7,076,947 | B2 | 7/2006 | Ariga et al. | |
| 7,412,827 | B2 | 8/2008 | Verkuilen | |
| 7,434,393 | B2 | 10/2008 | Hesse | |
| 7,836,811 | B1 * | 11/2010 | Gardner | F41A 23/28 102/402 |
| 7,878,770 | B2 | 2/2011 | Oka | |
| 8,061,180 | B2 | 11/2011 | Green | |
| 8,108,092 | B2 * | 1/2012 | Phillips | G05D 1/0033 701/23 |
| 8,281,757 | B2 | 10/2012 | Tomimatsu et al. | |
| 8,321,096 | B2 | 11/2012 | Sandstrom et al. | |
| 8,769,848 | B2 * | 7/2014 | Harrington | F41H 11/12 37/307 |
| 10,180,685 | B2 * | 1/2019 | Ratanaphanyarat | G05D 1/0246 |
| 2004/0206155 | A1 | 10/2004 | Sosnowski | |
| 2008/0053191 | A1 | 3/2008 | Yoo et al. | |
| 2008/0121097 | A1 * | 5/2008 | Rudakevych | F41A 19/58 89/28.05 |
| 2009/0037024 | A1 * | 2/2009 | Jamieson | G05B 19/0426 700/264 |
| 2010/0043421 | A1 | 2/2010 | Rub | |
| 2011/0061448 | A1 | 3/2011 | Cadman et al. | |
| 2011/0197576 | A1 | 8/2011 | Wada et al. | |
| 2011/0282519 | A1 | 11/2011 | Carlsson | |
| 2012/0095619 | A1 * | 4/2012 | Pack | G05D 1/0038 701/2 |
| 2012/0137667 | A1 | 6/2012 | Jacobsen et al. | |
| 2012/0185129 | A1 * | 7/2012 | Carrier | F41H 7/048 701/36 |
| 2012/0221144 | A1 * | 8/2012 | McElroy | F41B 9/0046 700/259 |
| 2013/0068309 | A1 | 3/2013 | Anderson | |
| 2013/0219877 | A1 | 8/2013 | Hughes et al. | |
| 2013/0287601 | A1 | 10/2013 | Mori et al. | |
| 2013/0297045 | A1 | 11/2013 | Yuan et al. | |
| 2013/0312397 | A1 | 11/2013 | Callaway et al. | |
| 2013/0332036 | A1 | 12/2013 | Yamamoto et al. | |
| 2014/0060020 | A1 | 3/2014 | Peterson et al. | |
| 2014/0174069 | A1 | 6/2014 | Kuehn et al. | |
| 2015/0113969 | A1 | 4/2015 | Kochhan et al. | |
| 2015/0136505 | A1 | 5/2015 | Bystedt | |
| 2015/0159682 | A1 | 6/2015 | Bae et al. | |
| 2015/0240455 | A1 | 8/2015 | Takebayashi et al. | |
| 2015/0299987 | A1 | 10/2015 | Ueda | |

FOREIGN PATENT DOCUMENTS

| | | | |
|---|---|---|---|
| CN | 101278131 | A | 10/2008 |
| CN | 101763121 | A | 6/2010 |
| CN | 102165201 | A | 8/2011 |
| CN | 203035627 | U | 7/2013 |
| DE | 103 40 993 | A1 | 3/2005 |
| DE | 103 42 037 | A1 | 4/2005 |
| EP | 0 796 952 | A1 | 9/1997 |
| EP | 2 508 680 | A1 | 10/2012 |
| EP | 2 589 709 | A2 | 5/2013 |
| JP | 2012141037 | A | 7/2012 |
| SE | 1050386 | A1 | 10/2011 |
| WO | 99/04936 | A1 | 2/1999 |
| WO | 00/78510 | A2 | 12/2000 |
| WO | 2014/207474 | A2 | 12/2014 |
| WO | 2015/117960 | A1 | 8/2015 |

OTHER PUBLICATIONS

International Search Report and Written Opinion for International Application No. PCT/SE2016/051014 dated Jan. 20, 2017.
International Search Report and Written Opinion for International Application No. PCT/SE2016/051015 dated Jan. 20, 2017.
International Preliminary Report on Patentability for International Application No. PCT/SE2016/051021 dated Apr. 24, 2018.
International Preliminary Report on Patentability for International Application No. PCT/SE2016/051014 dated Apr. 24, 2018.
International Preliminary Report on Patentability for International Application No. PCT/SE2016/051015 dated Apr. 24, 2018.

* cited by examiner

AUTOMATIC TUNING OF VALVE FOR REMOTE CONTROLLED DEMOLITION ROBOT

TECHNICAL FIELD

This application relates to the control of remote demolition robots, and in particular to automatically tuning a demolition robot to account for irregularities in a proportional valve arrangement.

BACKGROUND

Contemporary remote demolition robots suffer from a problem in that the mechanic force needed to open a valve may be different from robot to robot and it may also change over time. This may be due to for example hysteresis wherein the mechanical friction increases the mechanical force needed. A given control signal will therefore not indicate enough power to provide the required mechanical force to open the valve. The operator will then need to push a control switch such as a joystick even further in order to get the reaction wanted. This will result in a jerky and irregular operation of the robot. Also, the dead band in the control switch will be perceived as annoying to an operator. Furthermore, a same position of the control will provide different results depending on from which direction the control switch was operated.

There is thus a need for a remote demolition robot that is able to operate more smoothly.

SUMMARY

On object of the present teachings herein is to solve, mitigate or at least reduce the drawbacks of the background art, which is achieved by the appended claims.

A first aspect of the teachings herein provides a remote controlled demolition robot comprising a controller and at least one control switch for providing a control signal that is received by the controller, wherein the controller (17) is configured to control the operation of a corresponding robot part. The controller is further configured to: receive a pressure sensor reading from a pressure sensor for a proportional hydraulic valve, said pressure sensor reading indicating a standby pressure; provide the control signal to the valve; increase a signal level of the control signal provided to the valve until a change in the pressure is detected; and determine a starting offset for the valve, said starting offset corresponding to the current signal level of the control signal.

This allows the controller to accommodate for any differences between a real life valve and an ideal valve model when using the valve by tuning the real life valve.

In one embodiment the controller is further configured to receive a second pressure sensor reading from the pressure sensor for the valve; decrease the signal level of the control signal provided to the valve until the second pressure sensor reading corresponds to the standby pressure; determine a stopping offset for the valve, said stopping offset corresponds to the current signal level of the control signal.

This allows the controller to accommodate for any differences between a real life valve and an ideal valve model also when closing the valve.

A second aspect provides a method for use in a method for operating demolition robot comprising a controller and at least one control switch for providing a control signal that is received by the controller, wherein the controller is configured to control the operation of a corresponding robot part, wherein the method comprises: receiving a pressure sensor reading from a pressure sensor for a proportional hydraulic valve, said pressure sensor reading indicating a standby pressure; providing the control signal to the valve; increasing a signal level of the control signal provided to the valve until a change in the pressure is detected; and determining a starting offset for the valve, said starting offset corresponding to the current signal level of the control signal.

In one embodiment the method further comprises: receiving a second pressure sensor reading from the pressure sensor for the valve; decreasing the signal level of the control signal provided to the valve until the second pressure sensor reading corresponds to the standby pressure; determining a stopping offset for the valve, said stopping offset corresponds to the current signal level of the control signal.

A third aspect of the teachings herein provides a remote controlled demolition robot comprising a controller and at least one control switch for providing a control signal that is received by the controller, wherein the controller is configured to control the operation of a corresponding robot part, wherein the controller is further configured to receive the control signal from the control switch; adapt the control signal according to an offset; and provide the adapted control signal to a proportional hydraulic valve.

This allows the controller to accommodate by trimming for any differences between a real life valve and an ideal valve model when using the valve.

A fourth aspect provides a method for use in a method for operating a remote controlled demolition robot comprising a controller and at least one control switch for providing a control signal that is received by the controller, wherein the controller is configured to control the operation of a corresponding robot part, wherein the method comprises: receiving the control signal from the control switch; adapting the control signal according to an offset; and providing the adapted control signal to a proportional hydraulic valve.

A fifth aspect provides a computer-readable medium comprising software code instructions, that when loaded in and executed by a controller causes the execution of a method according to herein.

One benefit is that a demolition robot may be tuned and trimmed to accommodate or take account of irregularities such as mechanic friction, variations in solenoids and/or springs etc thereby providing a smoother control of the demolition robot. And, for which a same position of a control switch will provide the same effect (such as speed) independent of which direction the control is actuated in.

Other features and advantages of the disclosed embodiments will appear from the following detailed disclosure, from the attached dependent claims as well as from the drawings.

BRIEF DESCRIPTION OF DRAWING

The invention will be described below with reference to the accompanying figures wherein.

DETAILED DESCRIPTION

Figure 1:
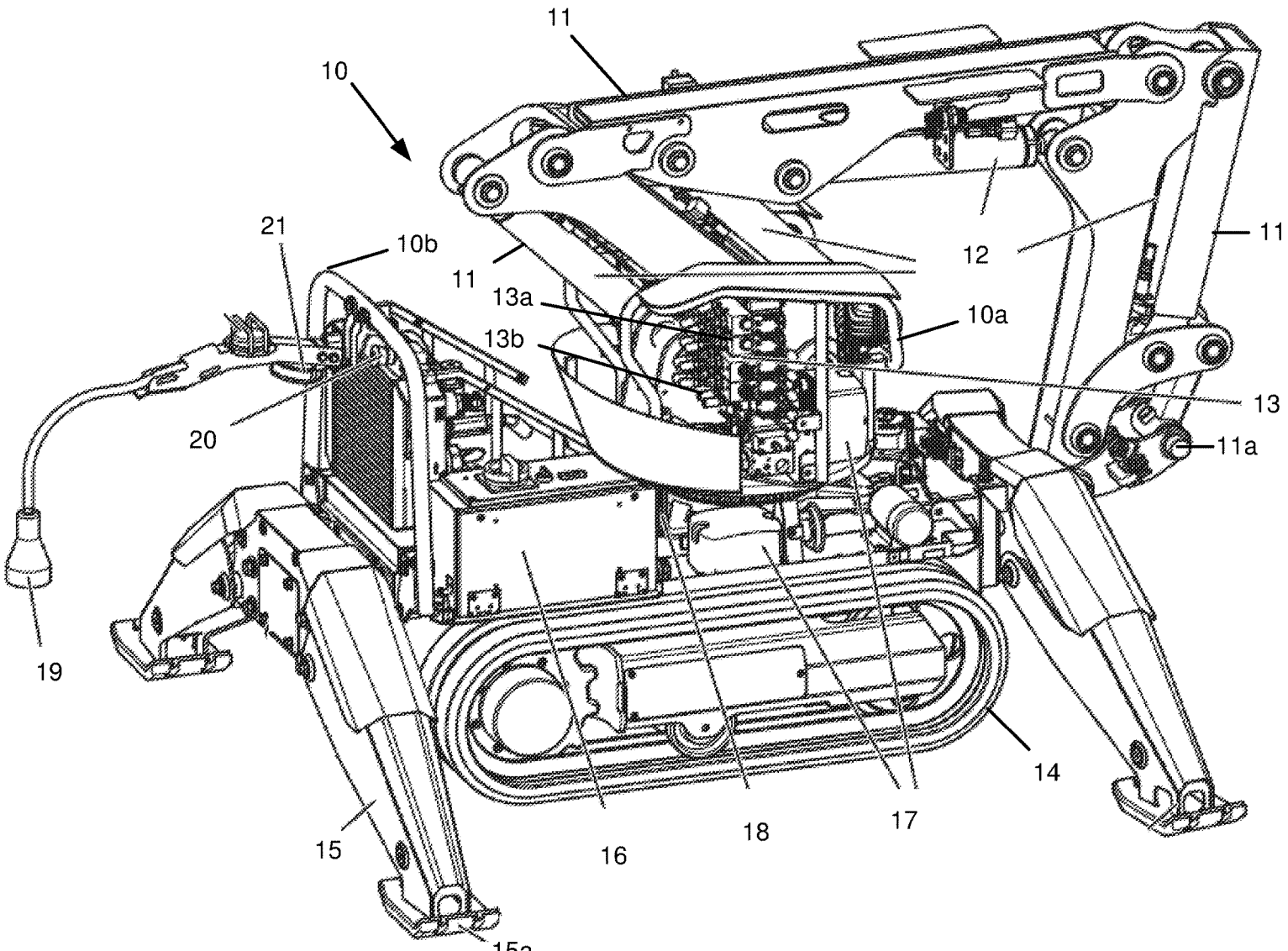
FIG. 1 shows a remote controlled demolition robot according to an embodiment of the teachings herein.

FIG. 1 shows a remote controlled demolition robot 10, hereafter simply referred to as the robot 10. The robot 10 comprises one or more robot members, such as arms 11, the arms 11 possibly constituting one (or more) robot arm member(s). One member may be an accessory tool holder 11*a* for holding an accessory 11*b* (not shown in FIG. 1, see FIG. 3). The accessory 11*b* may be a tool such as a hammer, a cutter, a saw, a digging bucket to mention a few examples. The accessory may also be a payload to be carried by the robot 10. The arms 11 are movably operable through at least one cylinder 12 for each arm 11. The cylinders are preferably hydraulic and controlled through a hydraulic valve block 13 housed in the robot 10.

The hydraulic valve block 13 comprises one or more valves 13*a* for controlling the amount of hydraulic fluid (oil) provided to for example a corresponding cylinder 12. The valve 13*a* is a proportional hydraulic valve.

The valve block 13 also comprises (possibly by being connected to) one or more pressure sensors 13*b* for determining the pressure before or after a valve 13*a*. There may be one pressure sensor 13*b* associated with more than one valve 13*a*.

The robot 10 comprises caterpillar tracks 14 that enable the robot 10 to move. The robot may alternatively or additionally have wheels for enabling it to move, both wheels and caterpillar tracks being examples of drive means. The robot further comprises outriggers 15 that may be extended individually (or collectively) to stabilize the robot 10. At least one of the outriggers 15 may have a foot 15*a* (possibly flexibly arranged on the corresponding outrigger 15) for providing more stable support in various environments. The robot 10 is driven by a drive system 16 operably connected to the caterpillar tracks 14 and the hydraulic valve block 13. The drive system may comprise an electrical motor in case of an electrically powered robot 10 powered by a battery and/or an electrical cable 19 connected to an electrical grid (not shown), or a cabinet for a fuel tank and an engine in case of a combustion powered robot 10.

The body of the robot 10 may comprise a tower 10*a* on which the arms 11 are arranged, and a base 10*b* on which the caterpillar tracks 14 are arranged. The tower 10*a* is arranged to be rotatable with regards to the base 10*b* which enables an operator to turn the arms 11 in a direction other than the direction of the caterpillar tracks 14.

The operation of the robot 10 is controlled by one or more controllers 17, comprising at least one processor or other programmable logic and possibly a memory module for storing instructions that when executed by the processor controls a function of the demolition robot 10. The one or more controllers 17 will hereafter be referred to as one and the same controller 17 making no differentiation of which processor is executing which operation. It should be noted that the execution of a task may be divided between the controllers wherein the controllers will exchange data and/or commands to execute the task.

The robot 10 may further comprise a radio module 18. The radio module 18 may be used for communicating with a remote control (see FIG. 2, reference 22) for receiving commands to be executed by the controller 17 The radio module 18 may be used for communicating with a remote server (not shown) for providing status information and/or receiving information and/or commands. The controller may thus be arranged to receive instructions through the radio module 18. The radio module may be configured to operate according to a low energy radio frequency communication standard such as ZigBee®, Bluetooth® or WiFi®. Alternatively or additionally, the radio module 18 may be configured to operate according to a cellular communication standard, such as GSM (Global Systeme Mobile) or LTE (Long Term Evolution).

The robot 10, in case of an electrically powered robot 10) comprises a power cable 19 for receiving power to run the robot 10 or to charge the robots batteries or both. For wired control of the robot 10, the remote control 22 may alternatively be connected through or along with the power cable 19. The robot may also comprise a Human-Machine Interface (HMI), which may comprise control buttons, such as a stop button 20, and light indicators, such as a warning light 21.

Figure 2:
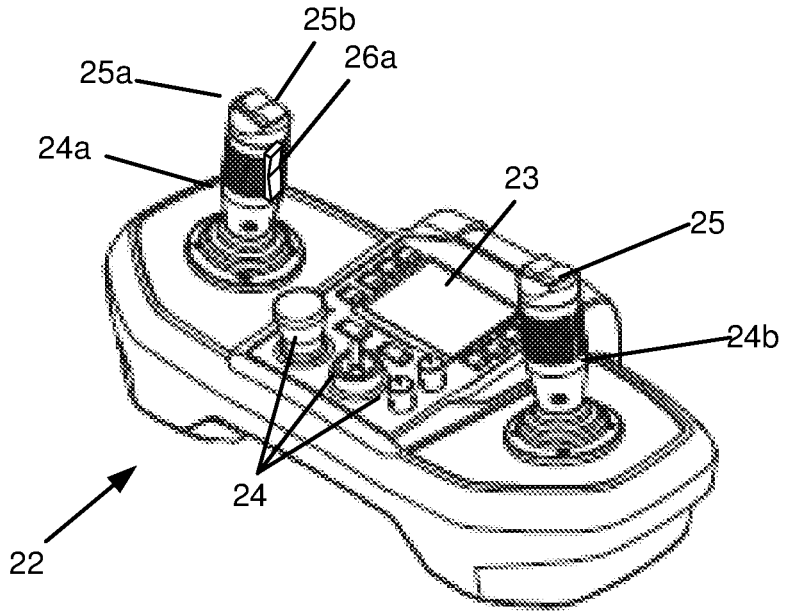
FIG. 2 shows a remote control 22 for a remote controlled demolition robot according to an embodiment of the teachings herein.

FIG. 2 shows a remote control 22 for a remote controlled demolition robot such as the robot 10 in FIG. 1. The remote control 22 may be assigned an identity code so that a robot 10 may identify the remote control and only accept commands from a correctly identified remote control 22. This enables for more than one robot 10 to be working in the same general area. The remote control 22 has one or more displays 23 for providing information to an operator, and one or more controls 24 for receiving commands from the operator. The controls 24 include one or more joysticks, a left joystick 24*a* and a right joystick 24*b* for example as shown in FIG. 2, being examples of a first joystick 24*a* and a second joystick 24*b*. It should be noted that the labeling of a left and a right joystick is merely a labeling used to differentiate between the two joysticks 24*a*, 24*b*. A joystick 24*a*, 24*b* may further be arranged with a top control switch 25. In the example of FIG. 2A, each joystick 24*a*, 24*b* is arranged with two top control switches 25*a*, 25*b*. The joysticks 24*a*, 24*b* and the top control switches 25 are used to provide maneuvering commands to the robot 10. The control switches 24 may be used to select one out of several operating modes, wherein an operating mode determines which control input corresponds to which action. For example: in a Transport mode, the left joystick 24*a* may control the caterpillar tracks 14 and the right joystick 24*b* may control the tower 10*a* (which can come in handy when turning in narrow passages); whereas in a Work mode, the left joystick 24*a* controls the tower 10*a*, the tool 11*b* and some movements of the arms 11, and the right joystick 24*b* controls other movements of the arms 11; and in a Setup mode, the each joystick 24*a*, 24*b* controls each a caterpillar track 14, and also controls the outrigger(s) 15 on a corresponding side of the robot 10. It should be noted that other associations of functions to joysticks and controls are also possible.

The remote control 22 may be seen as a part of the robot 10 in that it is the control panel of the robot 10. This is especially apparent when the remote control is connected to the robot through a wire. However, the remote control 22 may be sold separately to the robot 10 or as an additional accessory or spare part.

The remote control 22 is thus configured to provide control information, such as commands, to the robot 10 which information is interpreted by the controller 17, causing the robot 10 to operate according to the actuations of the remote control 22.

Figure 3:
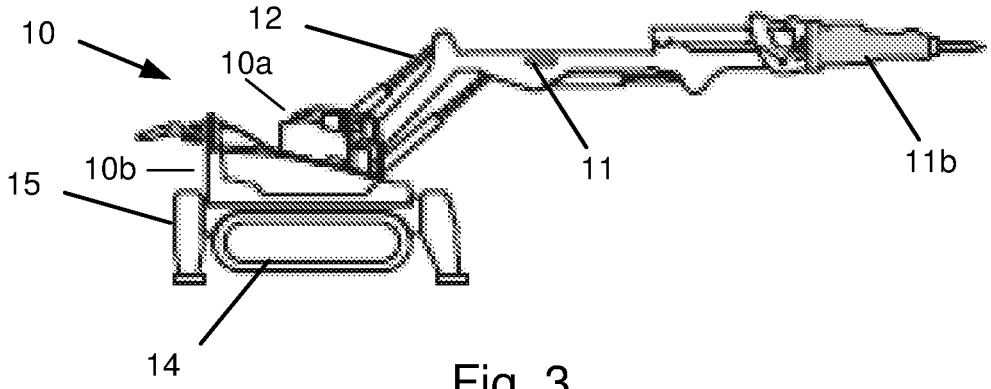
FIG. 3 shows a schematic view of a robot according to an embodiment of the teachings herein.

FIG. 3 shows a schematic view of a robot 10 according to FIG. 1. In FIG. 3, the caterpillar tracks 14, the outriggers 15, the arms 11 and the hydraulic cylinders 12 are shown. A tool 11*b*, in the form of a hammer 11*b*, is also shown (being shaded to indicate that it is optional).

As the controller 17 receives input relating for example to moving a robot member 11, for example from any of the joysticks 24, the corresponding valve 13*a* is controlled to open or close depending on the movement or operation to be made. One example of such movements is moving a robot member 11. One example of such operations is activating a tool 11*b* such as a hammer.

The inventors have realized that as the valves are mechanical parts, and therefore subject to wear and tear and also to friction, the amount of power supplied to control the valve may not only be different from robot 10 to robot 10, but also vary over time. This is also due to variations in the manufacturing of the valves, for example relating to the spring force, friction and the solenoid. Furthermore, the amount of power required to move the valve 13*a* may also be different depending on the current position of the valve 13*a*. The amount of power required to move the valve 13*a* will also be different depending on whether the valve is already moving or not.

Also, a valve that has been replaced or serviced may have a different characteristic which also may cause a dead band when controlling it.

Due to such irregularities for example resulting from hysteresis in the valve 13*a*, the signal (or power) that is required to open the valve 13*a* (when the joystick or other control switch is moved in one direction) is greater than it would have been for an ideal valve.

Similarly, as the inventors have realized, the same is true albeit different, when the valve is to be closed (i.e. when the joystick or other control switch is moved in the opposite direction to return to an idle position).

The inventors have therefore devised a clever and insightful arrangement for automatically tuning for such irregularities.

Figure 4A:
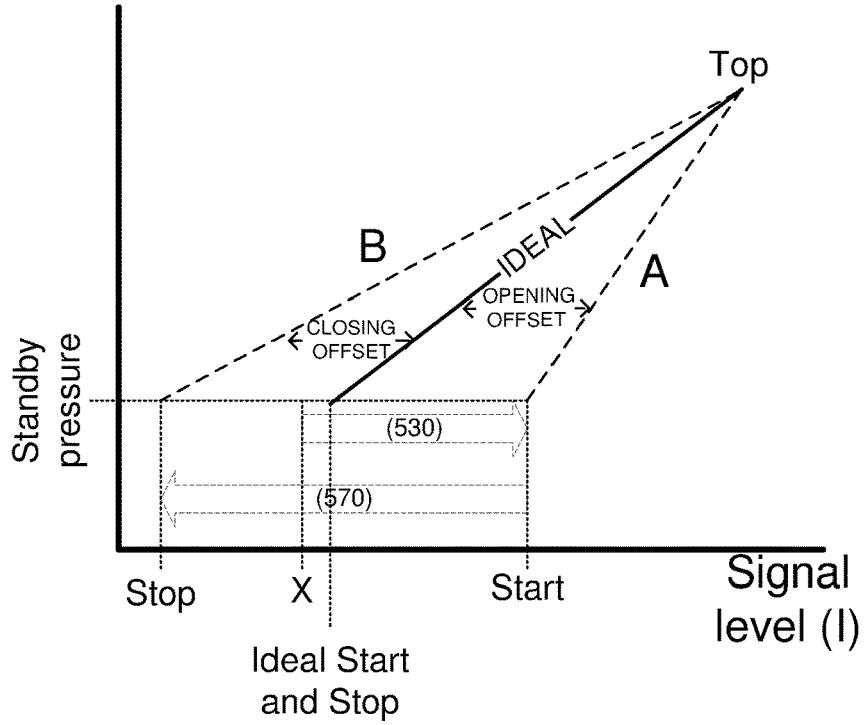
FIGS. 4A and 4B each shows a schematic graph of a signal applied and the opening of the valve in a remote controlled demolition robot according to an embodiment of the teachings herein.

FIG. 4A shows a schematic graph illustrating the relationship between the position of the valve 13*a* or the flow (Q) through it when it is opened and the current supplied to the valve through a control signal. The current is supplied and regulated by the controller 17 sending a signal S to the valve 13*a*. The graph of FIG. 4A is thus shown to illustrate the relationship between the signal S and the valve position (or angle) and the corresponding flow (Q).

The full drawn line indicates the relationship between valve position and the signal level provided for an ideal valve. The dashed lines indicate the real-life relationship for a valve.

As can be seen, the signal level needs to be higher when opening a valve 13*a* than for an ideal valve as is indicated by the dashed line A. This line A indicates the signal level actually needed for operating the valve.

The line A indicates absolute offset values to be used, but may alternatively be used to determine a relative offset value to be used in addition to what would have been needed for an ideal valve. Regardless of this value being an absolute value or an offset value it will hereafter be referred to as an offset or a hysteresis offset (even though it may depend on other factors than hysteresis).

As can be seen, the amount of additional signal output becomes less the more the valve is opened (the line A approaches the ideal line).

The difference between the real-life line A and the ideal line will result in that the joystick 24 or other control switch will have to be moved a certain distance (equaling the offset) before any movement or operation is detectable, which will cause a dead band when issuing a command and executing the corresponding action. This will most assuredly result in reduced accuracy when operating the robot.

To determine the offset for opening a valve 13*a*, the controller is configured to receive a pressure sensor reading for the valve 13 from the pressure sensor 13*b* corresponding to the valve 13*a* and store this as the standby pressure.

The starting pressure (being the standby pressure for the system) and a starting signal level are noted. In FIG. 4A, the starting signal level could be 0, but to save time, the staring signal level is chosen to be (slightly) less than what would have been the ideal starting signal level. This start point for the tuning of the signal level is denoted by X in FIG. 4A. The signal level is thereafter increased until an increase in pressure is detected which is indicative of that the valve is opening and the flow through the valve has increased. The current signal level is then noted. The difference between the ideal starting signal level and the noted current signal level represents the offset for starting to open the valve 13*a*. The current signal level is thus a real-life starting offset to be used when controlling the valve 13*a*, indicated by "Start" in FIG. 4A.

In one embodiment, the offset is a value specific to the control switch (such as a joystick or a thumb control) or other control switch proportionally controlling a movement) and is used as an offset to be added to the signal value provided by the control switch. In such an embodiment, the controller 17 may be configured to receive a control signal indication from a control (24) switch and to adapt the control signal by adding the offset for the control switch. As noted above, the offset may also be an absolute offset value to be associated with the received control signal indication In one embodiment, the offset is also dependent on the actual valve position and will thus vary accordingly. By noting the valve position at a given signal value and comparing to an expected valve position, a correlation between the ideal signal and the actual signal needed may be generated.

The expected valve position may also be determined based on a model for the current valve. Such a model may be determined by simply aligning the line A with the endpoint of the ideal line. The ideal line ends in a top signal level (indicated "Top" in FIG. 4A) that is given by a data sheet provided by the manufacturer of the valve 13*a*. The top signal level may also be determined as an average of a number of valves being tested. By using the starting signal level as the starting point for the real-life offset line A and the top signal level as the end point, offsets for the whole operation of the valve may be determined from the real-life offset line A.

In such embodiments, the controller 17 may be configured to receive a control signal indication from the control switch (24) and to adapt the control signal according to a correlation between the control signal and an actual signal required to provide the necessary signal level. The control signal may be adapted by being replaced by an absolute offset value, or by adding a relative offset value.

In other words, the controller 17 is thereby (through both embodiments) configured to follow the dashed lines providing a smooth operation of the valve 13*a*, instead of operating as for an ideal valve (full line) suffering from problems that the ideal valve does not account for.

The adaptation needed is thus represented by the distance between the full line and the dashed lines.

As mentioned above, the inventors have realized that a similar situation arises when the valve 13*a* is to be closed. FIG. 4A also shows the relationship when the valve 13*a* is to be closed. The offset is here represented by the real-life offset line B. As can be seen, the additional signal level needed to close the valve (line B) may be different to the additional signal level needed to open the valve (line B). In the example of FIG. 4A, the closing signal level is less than the opening signal level.

To determine the real-life offset line B, the controller is configured to, as the starting signal level has been found, decrease the signal level and receiving a second pressure sensor reading indicating a pressure until the indicated pressure equals the previously stored standby pressure, which occurs when the valve is fully closed again. The current signal level at this point is noted as being a stopping signal level, indicated by "Stop" in FIG. 4A.

The real-life offset line B may then be determined by aligning it with the top signal level and with the stopping signal level.

The real-life offset line B may be used to adapt any control signal when closing the valve 13*a* in a manner similar to what has been disclosed above for the real-life offset line A.

It is thus possible to adapt the control signal both when a valve 13*a* is to be closed and when a valve 13*a* is to be opened in a manner that results in a smooth operation of the valve 13*a* and its corresponding robot member 11.

As has been discussed in the above a control signal for a valve corresponds to a received switch control signal received by the controller as a switch is actuated. The adaptation may be done by correlating (such as by replacing) the received switch control signal to the real-life offset line(s) A/B or by adapting the ideal line control signal level corresponding to the received switch control signal by adding the offset according to the real-life offset line(s) A/B.

The term ideal valve is used lightly here to refer to a valve as per the manufacturer's documentation or specification.

The controller 17 is thus configured to receive a control switch signal from a control switch, such as a joystick, and to adapt the control signal to account for irregularities in the valve arrangement to provide an expected flow level through a corresponding valve 13*a*.

The controller further determines in which direction the control switch is actuated, wherein one direction indicates a opening of the valve and the other (opposite) direction indicates a closing of the valve 13*a* (returning the control switch to an idle position) and adapts the control signal accordingly, wherein an actuation in a first direction provides for a first adaptation (according to real-life offset line A), and an actuation in a second direction provides for a second adaptation (according to real-life offset line B).

As mentioned above, an adaptation may be to add a signal offset to the control signal. The signal offset may be positive for the first adaptation and negative for the second adaptation.

Figure 4B:
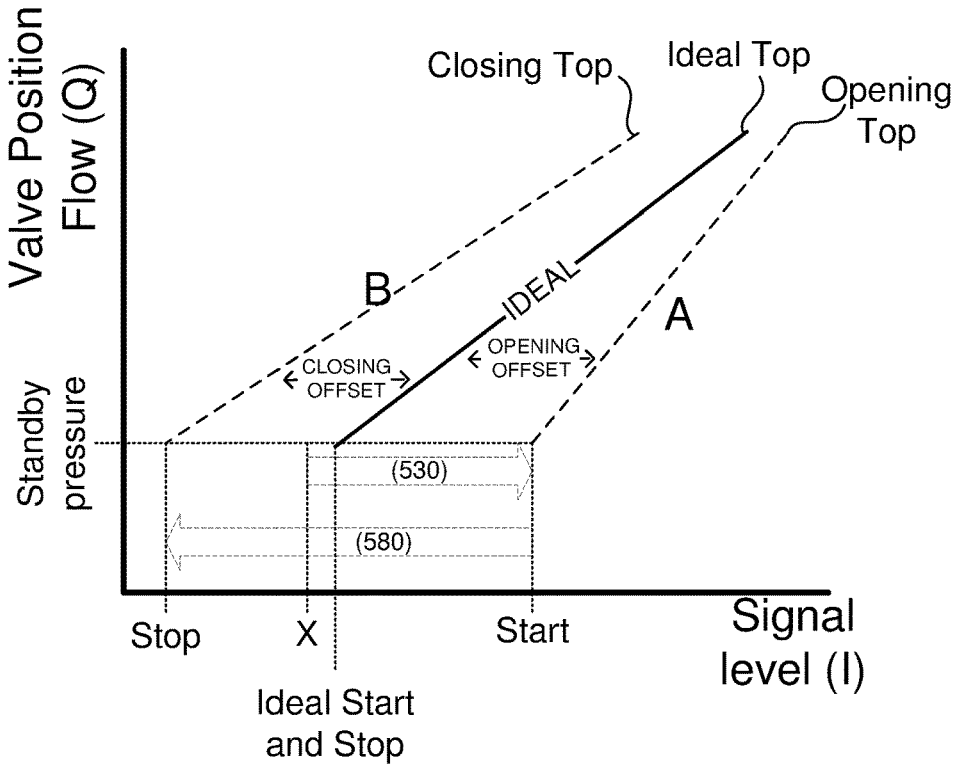

FIG. 4B also shows the relationship between an ideal valve and a real-life valve, but wherein two different top signal levels are indicated, an opening top signal level ("Opening Top") and a closing top signal level ("Closing Top") which may differ from the ideal top signal level ("Ideal Top"). Such top signal levels correspond better to a real-life valve as they may also differ from each other. In one embodiment the controller is thus configured to align the real-life offset line for opening the valve (line A) with the opening top signal level, and/or to align the real-life offset line for closing the valve (line B) with the closing top signal level.

Such top signal levels may be determined, through for example manual measurements, and thereafter be provided to the controller to be stored in the memory. They may be determined individually for a valve 13*a* or be based on an average for a number of valves 13*a*.

In one embodiment, either or both of the real-life offset lines (A or B) are taken to be parallel to the ideal line, thereby using a constant offset.

The inventors have further realized that this tuning may be performed automatically and is thus suited to be performed regularly or as a service or replacement of a spare part has been performed. Regular tuning helps account for changes due to wear (or temperature changes) for example.

Figure 5:
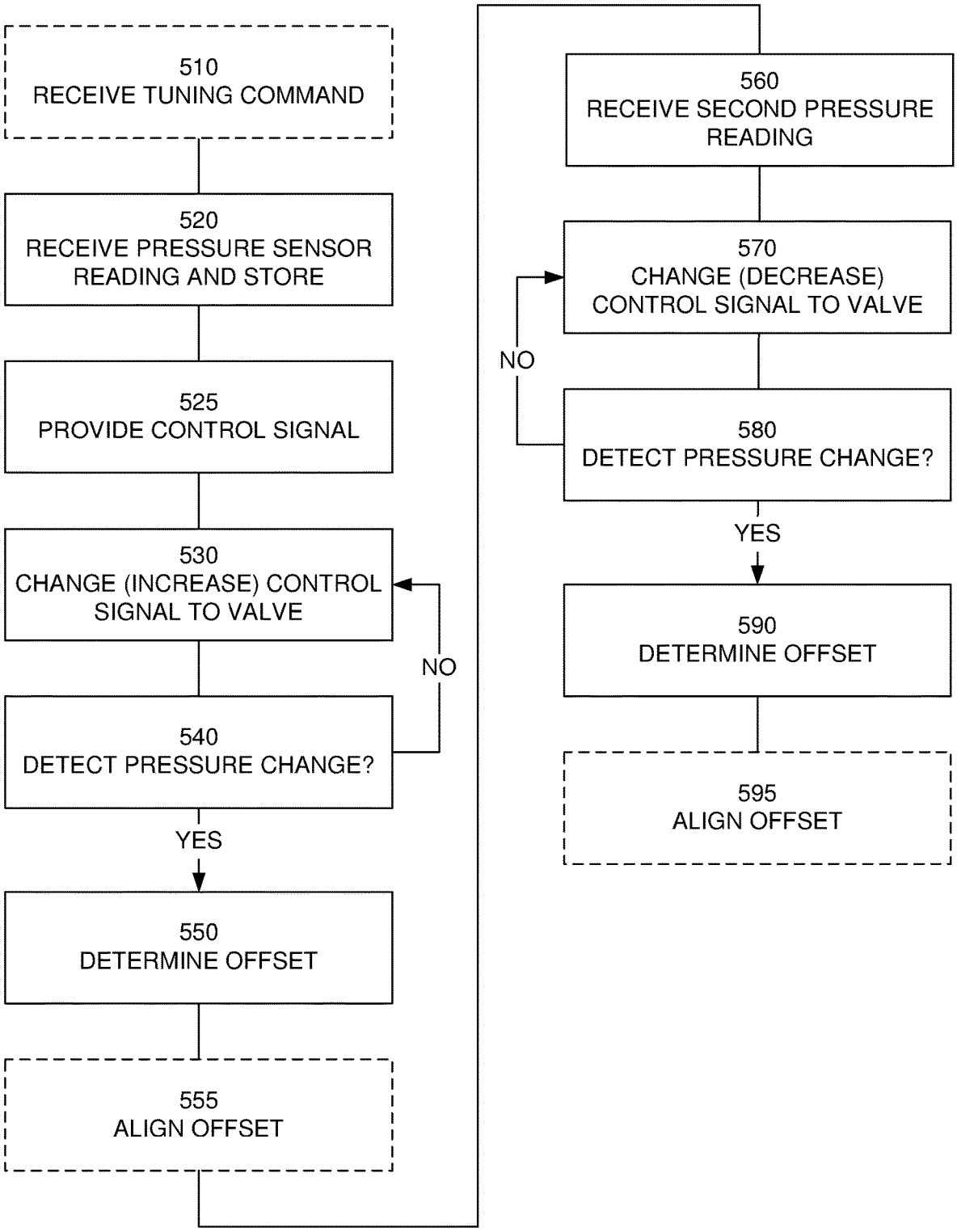
FIG. 5 shows a flowchart for a general method according to an embodiment of the teachings herein.

FIG. 5 shows a flowchart for a general method of tuning according to herein. For the purpose of this disclosure a tuning will be meant to be the procedure to ascertain an offset (line) and a trimming will be used to denote a procedure when a signal is adapted according to the offset (line) determined by the tuning.

The controller 17 may receive an indication that a tuning is to be performed 510, such as by receiving a tuning command. The tuning command may be received through a user interface (such as a button) or it may be received from operating instructions stored in the memory of the controller 17. The tuning may thus be performed automatically by issuing a tuning command through the user interface, or it may be performed autonomously possibly continuously or regularly by the controller's own volition, according to its operating instructions. The tuning command may thus be replaced by receiving a control signal if the tuning is to be performed continuously, or the tuning command may be implicit in the control signal. Alternatively, the tuning command may stipulate to tune next time a control signal is received.

It should be noted that for an automatic tuning, the control switch need not be actuated; a pressure increase or decrease can be effected anyway by the controller 17 by simply generating the control signal(s).

In one embodiment the tuning is initiated by giving a tuning command and then indicating the valve to be tuned by activating the corresponding switch.

The controller 17 receives 520 a pressure sensor reading from a pressure sensor 13*b* for the valve 13*a* and notes the standby pressure.

The controller 17 also receives a control signal possibly from a control switch 24, 25, 26 and provides a corresponding control signal 525 to a valve 13*a* corresponding to the actuated control switch. As stated above, the controller may generate and provide the control signal on its own accord, for example after having received a tuning command from the remote control 22. The reception of the switch control signal is thus optional. The controller then changes 530 (increases for opening the valve 13*a* 530 and decreases for closing the valve 13*a* 570) the signal level provided to the valve 13*a* until a change in the pressure is detected 540. This is indicated by the dashed arrows ("(530)" and "(560)") in FIGS. 4A and 4B.

The current signal level of the control signal is noted as the starting level ("Start") and the difference between the starting level and the ideal valve starting level (or the starting level in the case of an absolute offset) is determined 550 to be the offset for opening the valve 13*a*.

The real-life offset line A for opening the valve 13*a* may then be generated and aligned with the top (opening) signal level 555.

The procedure is then repeated for closing the valve 13*a*, wherein the controller 17 possibly receives a control signal from a control switch 24, 25, 26 indicating a decrease in the same direction, i.e. the control switch being returned to its idle position. Alternatively, the controller initiates the decrease in signal level by its own accord.

The controller 17 also receives 560 a second pressure sensor reading from a pressure sensor 13*b* for the valve 13*a* corresponding to the control signal and decreases 570 the signal until the pressure indicated by the second pressure reading corresponds to the standby pressure 580.

The current signal level of the control signal is noted as the stopping level ("Stop") and the difference between the stopping level and the ideal valve stopping level (or the stopping level in the case of an absolute offset) is determined 590 to be the offset for closing the valve 13*a*.

The real-life offset line B for closing the valve 13*a* may then be generated and aligned with the top (closing) signal level 595.

The controller 17 is thus enabled to automatically tune (of its own volition or after receiving a tuning command, possibly through the operating instructions stored in its memory) the valve both for opening the valve and for closing the valve by noting at what signal a change in pressure is detected and noting and mapping this signal value to future incoming control signals for that valve.

Figure 6:
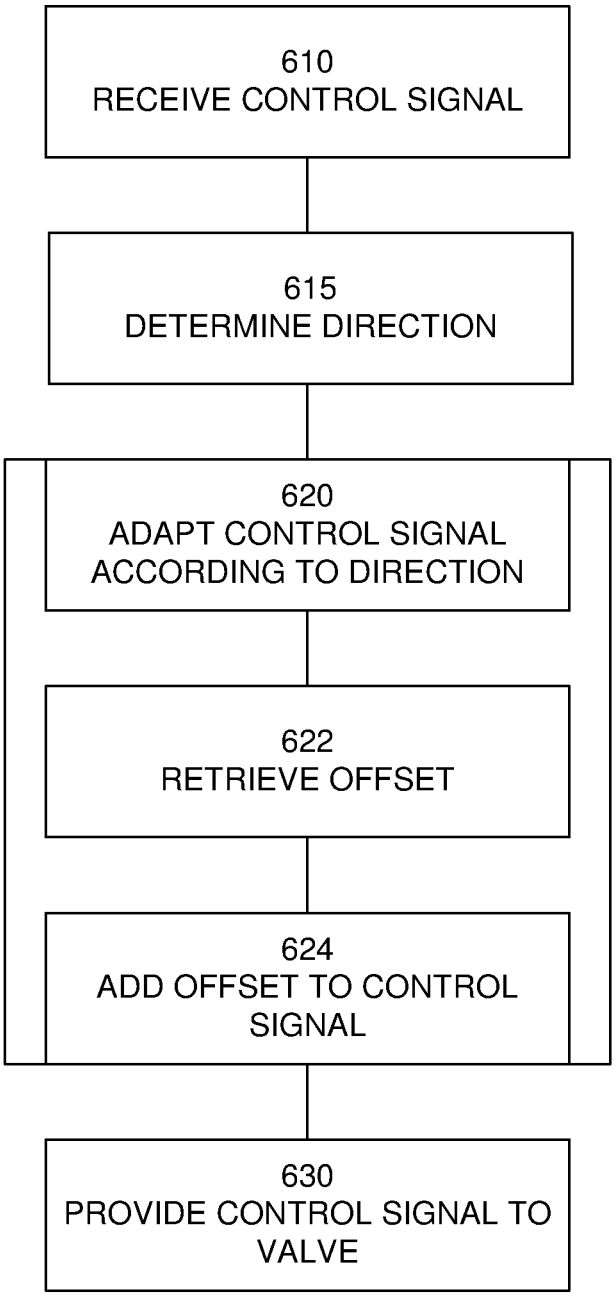
FIG. 6 shows a flowchart for a general method according to an embodiment of the teachings herein.

FIG. 6 shows a flowchart for a general method of trimming a valve according to herein. The controller 17 receives 610 a control signal from a control switch 24, 25, 26 and determine a direction (opening or closing of the valve) 615 indicated by the control signal. The controller 17 then adapts 620 the control signal according to the stored offset before providing 630 the control signal to a corresponding valve 13*a*.

As would be apparent to a skilled person, the switch control signal may directly (after possible offset adaptation) correspond to the control signal provided to the valve 13*a*, or the control signal for the valve may be determined based on the switch control signal.

The adaptation 620 may be performed by retrieving 622 an offset from a memory and adding 624 the offset to the control signal (relative offset).

The adaptation 620 may alternatively be performed by retrieving 622 an offset from a memory and using 624 the offset as the control signal (absolute offset).

Figure 7:
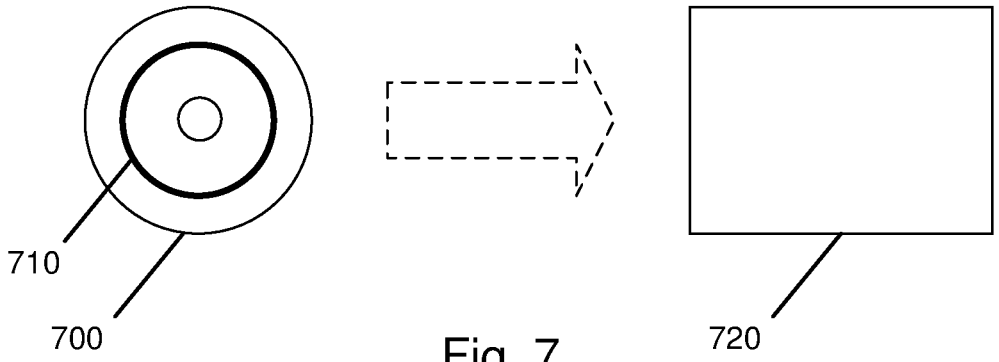
FIG. 7 shows a schematic view of a computer-readable product comprising instructions for executing a method according to one embodiment of the teachings herein.

FIG. 7 shows a computer-readable medium 700 comprising software code instructions 710, that when read by a computer reader 720 loads the software code instructions 710 into a controller, such as the controller 17, which causes the execution of a method according to herein. The computer-readable medium 700 may be tangible such as a memory disk or solid state memory device to mention a few examples for storing the software code instructions 110 or intangible such as a signal for downloading or transferring the software code instructions 710.

By utilizing such a computer-readable medium 700 existing robots 10 may be updated to operate according to the invention disclosed herein.

The invention has mainly been described above with reference to a few embodiments. However, as is readily appreciated by a person skilled in the art, other embodiments than the ones disclosed above are equally possible within the scope of the invention, as defined by the appended patent claims.

The invention claimed is:

1. A remote controlled demolition robot comprising a controller and at least one control switch for providing a control signal that is received by the controller, wherein the controller is configured to control operation of a corresponding robot part, wherein the controller is further configured to:

receive a pressure sensor reading from a pressure sensor for a proportional hydraulic valve, said pressure sensor reading indicating a standby pressure;

provide the control signal to the valve;

increase a signal level of the control signal provided to the valve until a change in the pressure sensor reading is detected; and determine a starting offset for the valve, said starting offset corresponding to a current signal level of the control signal.

2. The remote controlled demolition robot according to claim 1, wherein the controller is further configured to receive a second pressure sensor reading from the pressure sensor for the valve;

decrease the signal level of the control signal provided to the valve until the second pressure sensor reading corresponds to the standby pressure;

determine a stopping offset for the valve, said stopping offset corresponds to the current signal level of the control signal.

3. The remote controlled demolition robot according to claim 1, wherein the controller is further configured to receive an indication that a tuning is to be performed, and in response thereto generate the control signal.

4. The remote controlled demolition robot according to claim 1, wherein the controller is further configured to provide the control signal by receiving the control signal from a remote control.

5. The remote controlled demolition robot according to claim 1, wherein the controller is further configured to determine a real-life offset line for opening the valve by aligning the starting offset with a top signal level.

6. The remote controlled demolition robot according to claim 2, wherein the controller is further configured to determine a real-life offset line for closing the valve by aligning the stopping offset with a top signal level.

7. A remote controlled demolition robot comprising a controller and at least one control switch for providing a control signal that is received by the controller, wherein the controller is configured to control operation of a corresponding robot part, wherein the controller is further configured to receive a control signal from the control switch;

adapt the control signal according to an offset; and provide the adapted control signal to a proportional hydraulic valve.

8. The remote controlled demolition robot according to claim 7, wherein the controller is configured to adapt the control signal by adding the offset to the control signal.

9. The remote controlled demolition robot according to claim 7, wherein the offset is an offset control signal and the controller is configured to adapt the control signal by replacing the control signal with the offset control signal.

10. The remote controlled demolition robot according to claim 7, wherein the offset is retrieved from a real-life offset line.

11. A method for operating a remote controlled demolition robot comprising a controller and at least one control switch for providing a control signal that is received by the controller, wherein the controller is configured to control the operation of a corresponding robot part, wherein the method comprises:

receiving a pressure sensor reading from a pressure sensor for a proportional hydraulic valve, said pressure sensor reading indicating a standby pressure;

providing the control signal to the valve;

increasing a signal level of the control signal provided to the valve until a change in the pressure is detected; and determining a starting offset for the valve, said starting offset corresponding to a current signal level of the control signal.

12. The method according to claim 11, wherein the method further comprises:

receiving a second pressure sensor reading from the pressure sensor for the valve;

decreasing the signal level of the control signal provided to the valve until the second pressure sensor reading corresponds to the standby pressure;

determining a stopping offset for the valve, said stopping offset corresponds to the current signal level of the control signal.

13. A method for operating a remote controlled demolition robot comprising a controller and at least one control switch for providing a control signal that is received by the controller, wherein the controller is configured to control the operation of a corresponding robot part, wherein the method comprises:

receiving the control signal from the control switch;

adapting the control signal according to an offset; and providing the adapted control signal to a proportional hydraulic valve.

14. A non-transitory computer readable medium comprising software code instructions, that when loaded in and executed by a controller causes the execution of a method for operating a remote controlled demolition robot comprising a controller and at least one control switch for providing a control signal that is received by the controller, wherein the controller is configured to control the operation of a corresponding robot part, wherein the method comprises:

receiving a pressure sensor reading from a pressure sensor for a proportional hydraulic valve, said pressure sensor reading indicating a standby pressure;

providing the control signal to the valve;

increasing a signal level of the control signal provided to the valve until a change in the pressure is detected; and determining a starting offset for the valve, said starting offset corresponding to a current signal level of the control signal.

15. The remote controlled demolition robot according to claim 2, wherein the controller is further configured to provide the control signal by receiving the control signal from the remote control.

* * * * *